US007438400B2

(12) United States Patent
Kimura et al.

(10) Patent No.: US 7,438,400 B2
(45) **Date of Patent: *Oct. 21, 2008**

(54) LIQUID CONTAINER, LIQUID EJECTING DEVICE, AND METHOD OF CHECKING ARRANGEMENT OF LIQUID STORING PACKS

(75) Inventors: Hitotoshi Kimura, Nagano (JP); Michinari Tsukahara, Nagano (JP); Masanori Kobayashi, Nagano (JP); Morio Sato, Nagano (JP); Kenji Ochiai, Nagano (JP); Yasuto Sakai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 218 days.

This patent is subject to a terminal disclaimer.

(21) Appl. No.: 10/892,764

(22) Filed: Jul. 16, 2004

(65) Prior Publication Data

US 2005/0057620 A1 Mar. 17, 2005

(30) Foreign Application Priority Data

| | | |
|---|---|---|
| Jul. 16, 2003 | (JP) | 2003-198042 |
| Dec. 24, 2003 | (JP) | 2003-428220 |
| Apr. 20, 2004 | (JP) | 2004-124249 |

(51) Int. Cl.
*B41J 2/175* (2006.01)

(52) U.S. Cl. ..... 347/86

(58) Field of Classification Search ..... 347/85, 347/86; 116/227, 281
See application file for complete search history.

(56) References Cited

U.S. PATENT DOCUMENTS

| | | | | |
|---|---|---|---|---|
| 4,447,820 | A * | 5/1984 | Terasawa | 347/86 |
| 5,307,091 | A * | 4/1994 | DeCoste, Jr. | 347/86 |
| 5,710,585 | A | 1/1998 | Sabonis et al. | |
| 5,793,387 | A * | 8/1998 | Hunt | 347/7 |
| 6,019,462 | A * | 2/2000 | Noaki | 347/86 |
| 6,053,606 | A * | 4/2000 | Yamaguchi et al. | 347/86 |
| 6,106,112 | A * | 8/2000 | Okubo et al. | 347/86 |
| 6,183,075 | B1 | 2/2001 | Sasaki | |
| 6,227,661 | B1 * | 5/2001 | Hayakawa | 347/86 |
| 6,276,787 | B1 * | 8/2001 | Sakanobe et al. | 347/86 |
| 6,558,340 | B1 * | 5/2003 | Traeger | 604/5.01 |
| 6,609,789 | B1 * | 8/2003 | Hunt | 347/86 |
| 2004/0218021 | A1 * | 11/2004 | Ishizawa et al. | 347/86 |

FOREIGN PATENT DOCUMENTS

| | | | |
|---|---|---|---|
| DE | 41 04 786 | A1 | 9/1991 |
| EP | 0 834 403 | A2 | 4/1998 |
| EP | 0 927 638 | A2 | 7/1999 |
| JP | 401242256 | A * | 9/1989 |
| JP | 09-020018 | A | 1/1997 |
| JP | 409012147 | A * | 1/1997 |
| JP | 09-058007 | A | 3/1997 |

(Continued)

*Primary Examiner*—Anh T. N. Vo
(74) *Attorney, Agent, or Firm*—Stroock & Stroock & Lavan LLP

(57) ABSTRACT

In a liquid container in which a liquid container case accommodates at least three liquid storing packs under a condition that the liquid storing pack partially overlaps the adjacent liquid storing pack, amounts of liquid stored in the respective liquid storing packs have a plurality of levels, and the liquid pack storing the most amount of the liquid is arranged at parts other than the center of arrangement.

24 Claims, 9 Drawing Sheets

FOREIGN PATENT DOCUMENTS

| | | | | |
|---|---|---|---|---|
| JP | 09-249228 | A | | 9/1997 |
| JP | 2000-296626 | A | | 10/2000 |
| JP | 2001-509103 | A | | 7/2001 |
| JP | 2002-120382 | A | | 4/2002 |
| JP | 2003-053984 | | * | 2/2003 |
| JP | 2003-053984 | A | | 2/2003 |
| WO | 98/31548 | A1 | | 7/1998 |

* cited by examiner

LIQUID CONTAINER, LIQUID EJECTING DEVICE, AND METHOD OF CHECKING ARRANGEMENT OF LIQUID STORING PACKS

BACKGROUND OF THE INVENTION

Conventionally, an ink jet type recoding device has widely been used as one of liquid ejecting devices. The ink jet type recoding device includes so-called off-carriage type which connects, via ink supply tubes, an ink cartridge as a liquid container installed at a place other than a carriage to a recording head as a liquid ejecting head having a nozzle. As the ink cartridge employed to the ink jet type recording device of the off-carriage type, there is, for example, such an ink cartridge which accommodates the ink packs as the liquid storing packs comprising a flexible film. For discharging the ink from the ink cartridge, an air is sent under pressure into a case by a pressure pump, and the ink pack is pressed by pressure of the air to push out the ink. The ink pushed out from the ink pack is sent under pressure to the recording head via the ink supply tube. The ink supplied to the recording head is ejected as ink droplets to a recording paper from an opening of the nozzle provided at the recording head.

As the ink cartridge, there has been proposed, for example, an ink cartridge which accommodates a plurality of ink packs overlapping one another within the case (see, for example, patent literature 1). This ink cartridge reduces a dead space in the case by accommodating the ink packs such that the ink pack overlaps an adjacent ink pack at parts each other.

Patent literature 1: Laid Open No. 2003-53984

However, in case the plurality of overlapped ink packs are accommodated in one case as the ink cartridge of Patent Literature 1, one ink pack contacts an adjacent ink pack, and pressing pressure acts thereon. Since an ink bag forming the ink pack is made of a flexible material as a laminated film, such pressing pressure gives influences to an internal pressure in the ink pack and causes a problem pressure differential per each of the ink packs.

In general, if water head of pressure is too high in the ink jet type printer, the ink leaks from the nozzle. Therefore, in the off-carriage type printer, the ink cartridge is placed below than the nozzle such that water head of pressure falls in a determined range (negative pressure). But, in case pressure differential occurs per each of the ink packs, for getting sufficient negative pressure in all the ink packs, difference of elevation must be further secured, and a problem is caused that the device is made large by such amount. The present invention has been made in view of the above mentioned problems, and it is an object of the invention to provide a liquid container which enables to reduce pressure differential in the plurality of liquid storing packs efficiently accommodated in one liquid container, and a liquid ejecting device.

In the ink cartridge disclosed in Patent Literature 1, the order of accommodating the respective ink packs is in advance determined. For example, the ink pack storing a black ink is arranged in a position for the black ink within the case, whereby the black ink is ejected from a nozzle row through a corresponding ink supply tube for the black ink. In short, since the respective positions for arranging the ink packs and the respective nozzle rows of the recording head correspond to one another, if the ink pack is arranged in a wrong position, a different, undesired ink is ejected from the nozzle. Therefore, not only a bad printing is caused, but also the ink supply tube and an ink passage within the recording head are stained by mixing different inks.

It is another object of the invention to provide the liquid container which enables to prevent erroneous arrangement of the liquid storing packs, the liquid ejecting device and the method of checking arrangement of the liquid storing packs.

SUMMARY OF THE INVENTION

A liquid container according to the invention is so designed that a liquid container case accommodates a plurality of liquid storing packs such that the liquid storing pack partially overlaps the adjacent liquid storing pack each other. The amounts of liquid stored in the liquid storing packs have a plurality of levels, and the liquid storing packs are arranged in the liquid container case in accordance with the amounts of the liquid so as to reduce pressure differential between the liquid storing packs to a minimum.

This way, the liquid storing pack having high internal pressure owing to much amount of the stored liquid is arranged at a position where it is less influenced by pushing pressure effected from the adjacent liquid storing pack. The liquid storing pack having low internal pressure owing to less amount of the stored liquid is arranged at the position where it is much influenced by pushing pressure effected from the adjacent liquid storing pack. Therefore, in the liquid container efficiently accommodating the plurality of liquid storing packs, pressure differential of the liquid stored in the liquid storing packs can be reduced.

A liquid container according to the invention is so designed that the liquid container case accommodates at least three liquid storing packs such that the liquid storing pack partially overlaps the adjacent liquid storing pack. The amounts of the liquid stored in the liquid storing packs have a plurality of levels, and the pack storing the most amount of liquid is arranged at a place other than a center of arrangement.

This way, the liquid storing pack having the highest internal pressure owing to the most amount of the stored liquid is arranged at the place excepting the center of arrangement where it is most influenced by pushing pressure effected from the adjacent liquid storing pack. Therefore, in the liquid container efficiently accommodating at least three liquid storing packs, pressure differential of the liquid stored in the liquid storing packs can be reduced.

According to the present invention, the pack storing the most amount of liquid may be arranged at an end of arrangement.

This way, the liquid storing pack having highest internal pressure owing to the most amount of the stored liquid is arranged at the place excepting the center of arrangement where it is most influenced by pushing pressure effected from the adjacent liquid storing pack. Therefore, in the liquid container efficiently accommodating at least three liquid storing packs, pressure differential of the liquid stored in the liquid storing packs can be reduced.

According to the present invention, the pack storing the least amount of liquid may be arranged at the center of arrangement.

This way, the liquid storing pack having least internal pressure owing to the least amount of the stored liquid is arranged at the center of arrangement where it is most influenced by pushing pressure effected from the adjacent liquid storing pack. Therefore, in the liquid container efficiently accommodating at least three liquid storing packs, pressure differential of the liquid stored in the liquid storing packs can be reduced.

According to the present invention, the liquid storing packs may be arranged from both ends to the center in order from the pack storing more amount of the liquid.

This way, the liquid storing pack having the higher internal pressure owing to the more amount of the stored liquid is arranged at the outer side where it is less influenced by pushing pressure effected from the adjacent liquid storing pack. Therefore, in the liquid container efficiently accommodating at least three liquid storing packs, pressure differential of the liquid stored in the liquid storing packs can be reduced.

According to the present invention, the liquid storing packs may be arranged from the center to both ends in order from the pack storing less amount of the liquid.

This way, the liquid storing pack having the lower internal pressure owing to the less amount of the stored liquid is arranged at the inner part where it is more influenced by pushing pressure effected from the adjacent liquid storing pack. Therefore, in the liquid container efficiently accommodating at least three liquid storing packs, pressure differential of the liquid stored in the liquid storing packs can be reduced.

According to the present invention, the liquid storing pack may comprise a bag body of flexible film and a liquid outlet member formed with a liquid outlet port for discharging the liquid from the interior of the bag body.

This way, in a state in which the liquid is stored, the liquid storing pack is in the form of a spindle-shape most expanded at the center of the flexible film. Therefore, by overlapping the side end portion of the adjacent liquid storing pack on the expanded center of the liquid storing pack, the plurality of liquid storing packs may be efficiently accommodated in the liquid container case. Accordingly, the liquid container may be reduced in size, and in turn, the liquid ejecting device having this liquid container may be miniaturized.

According to the present invention, the liquid storing pack may be formed by welding four sides of two sheets of flexible films.

This way, in a state in which the liquid is stored, the liquid storing pack is in the form of a spindle-shape most expanded at the center of the flexible film. Therefore, by overlapping the side end portion of the adjacent liquid storing pack on the expanded center of the liquid storing pack, the plurality of liquid storing packs may be efficiently accommodated in the liquid container case. Accordingly, the liquid container may be reduced in size, and in turn, the liquid ejecting device having this liquid container may be miniaturized.

According to the present invention, the liquid container case is furnished with supporting parts for supporting the liquid storing packs such that center axes of the liquid outlet ports are arrayed on the same horizontal plane.

This way, since the center axes of the liquid outlet ports are all arrayed on the same horizontal plane, the liquid surfaces of the liquid storing packs may be the same in height. Therefore, pressure differential of the liquid stored in each of the liquid storing packs may be reduced.

According to the present invention, the plurality of liquid storing packs may be accommodated such that the liquid storing packs are tilted at a predetermined angle with respect to the liquid container case.

This way, the plurality of liquid storing packs are accommodated so that they are tilted at the predetermined angle. By overlapping the side end portion of the adjacent liquid storing pack on the expanded center of the liquid storing pack, the plurality of liquid storing packs may be efficiently accommodated in the liquid container case. This is effective especially in the spindle-shaped liquid storing packs. Accordingly, the liquid container may be reduced in size, and in turn, the liquid ejecting device having this liquid container may be miniaturized.

According to the present invention, the liquid container case may be furnished with a posture keeping member for keeping the tilted posture of the liquid storing packs at the predetermined angle.

This way, the liquid storing packs can keep the posture tilting at the predetermined angle by means of the posture keeping member. Therefore, it is possible to avoid pressure variation of the liquid stored in the liquid storing packs, which would otherwise be caused by changing the posture of the liquid storing packs.

According to the present invention, the liquid storing packs maybe arranged at least four in the liquid container case, and the liquid storing packs are arranged more closely from the center to both ends.

This way, since the liquid storing pack located at an inner position, which is easily influenced by pushing pressure caused by contact with the adjacent liquid storing packs at both sides thereof, is more separate from the adjacent liquid storing packs, influences by pushing pressure may be decreased. As a result, in the liquid container efficiently accommodating the plurality of liquid storing packs, pressure differential of the liquid stored in the liquid storing packs can be decreased.

According to the present invention, the liquid may be an ink.

This way, the liquid storing pack having high internal pressure owing to much amount of the stored ink is arranged at a position where it is less influenced by pushing pressure effected from the adjacent liquid storing pack. The liquid storing pack having low internal pressure owing to less amount of the stored ink is arranged at the position where it is much influenced by pushing pressure effected from the adjacent liquid storing pack. Therefore, in the ink cartridge efficiently accommodating the plurality of liquid storing packs, pressure differential of the ink stored in the liquid storing packs can be reduced.

A liquid ejecting device according to the invention is characterized by comprising the above-mentioned liquid storing container.

This way, in the liquid ejecting device using the liquid container efficiently accommodating the plurality of liquid storing packs, pressure differential of the liquid stored in the liquid storing packs can be reduced.

A liquid container according to the present invention includes a plurality of liquid storing packs, each having an outlet part for discharging the liquid to an exterior, and a liquid storing part communicating with the outlet parts and containing the liquid therein. The liquid storing packs are arranged in predetermined arrangement order within a liquid container case so that the liquid storing part of the pack partially overlaps the liquid storing part of the adjacent pack. The liquid storing packs respectively have order distinguishing indicators on parts not overlapping other packs. The order distinguishing indicators show information concerning the arranging order of the liquid storing packs.

This way, the liquid storing packs, which are efficiently accommodated in the case by overlapping one another, are furnished with the order distinguishing indicators showing information concerning the arranging order. Therefore, on the basis of the order distinguishing indicators, the liquid storing packs may be accommodated within the case. Alternatively, on the basis of the order distinguishing indicators of the liquid storing packs accommodated within the case, it is possible to confirm whether or not the arranging order of the liquid storing packs are as predetermined. Further, since the order distinguishing indicators are provided on the parts not overlapping the other packs, the order distinguishing indicators are readable from the outside. Accordingly, the liquid storing packs are avoided from being accommodated in wrong order within the case. Further, a distinguishing means is constructed by the order distinguishing indicator, the liquid storing pack can be manufactured at low cost without providing a comparatively expensive memory element.

According to the present invention, the above-mentioned order distinguishing indicator may include an indication readable through a checking device.

This way, the order distinguishing indicator is shown with information readable by a reading instrument. Therefore, by causing the reading instrument to read the readable information, the order of the liquid storing packs can be efficiently confirmed.

According to the present invention, the above-mentioned order distinguishing indicator may be in the form of a bar-code.

This way, since the above-mentioned order distinguishing indicator is in the form of the bar-code, it is possible to read the data concerning the arranging order at high precision by comparatively easy operation.

According to the present invention, the order distinguishing indicators have shapes or sizes by which the arranging order can be distinguished visually, and the order distinguishing indicators are continuous in accordance with the arranging order.

This way, the order distinguishing indicators are distinguishable through the visual recognition, and are continuous in accordance with the arranging order. Therefore, since the liquid storing packs can be arranged within the case based on the visually recognizable indications, a wrong arrangement of the liquid storing packs can be prevented. In addition, by visually confirming whether or not the visually recognizable indications are continuous after all the liquid storing packs are accommodated within the liquid container case, it is possible to prevent the wrong arrangement of the liquid storing packs.

A liquid container according to the invention includes a plurality of liquid storing packs, each having an outlet part for discharging liquid to an exterior, and a liquid storing part communicating with the outlet part and containing the liquid therein. The liquid storing packs are arranged in predetermined arranging order within a liquid container case so that the liquid storing part of the pack partially overlaps the liquid storing part of the adjacent pack. The liquid storing packs respectively have first order distinguishing indicators, that indicate information on the predetermined arranging order of the packs, that have shapes or sizes by which the predetermined arranging order can be distinguished through the visual recognition, and that are continuous in accordance with the predetermined arranging order. The liquid storing packs also have second order distinguishing indicators, respectively, that indicate the information on the predetermined arranging order of the packs and that are readable through a checking device. The first and second order distinguishing indicators are provided on parts of the packs, not overlapping other packs.

This way, each of the liquid storing packs accommodated within the case, while overlapping one another has the first and second order distinguishing indicators showing information concerning the predetermined arranging order. The first order distinguishing indicators show the visible indications mutually continuous, and therefore it is possible to accommodate the packs within the case, while visually recognizing the first order distinguishing indicators. The second order distinguishing indicators show the indications readable by the reading instrument, and therefore the arranging order can be efficiently checked. Further, the arranging order of the liquid storing packs are twice confirmed by using the first and second order distinguishing indicators, it is possible to more reliably prevent the liquid storing packs from being accommodated in the wrong order. The first and second order distinguishing indicators are provided on the parts not overlapping the other packs, so that the order distinguishing indicator can be made readable from the outside. Therefore, it is possible to prevent the liquid storing packs from the wrong arrangement within the case.

A liquid ejecting device according to the invention is a liquid ejecting device mounting the above-mentioned liquid storing container thereon and having a liquid ejecting head having a plurality of nozzles for ejecting predetermined liquids. The plurality of nozzles communicate the liquid storing packs, respectively.

This way, the liquid container is employed in the liquid ejecting device, and the liquid storing packs respectively communicate with the nozzles of the liquid ejecting heads. Therefore, by avoiding the liquid storing packs from being arranged in the erroneous order, it is possible to preventing an undesired liquid other than a predetermined liquid from the nozzle.

The present invention further provides a method of checking arrangement of a plurality of liquid storing packs, each having an outlet part for discharging liquid to an exterior and a liquid storing part communicating with the outlet part and containing the liquid. After the liquid storing packs are accommodated in a liquid container case such that the liquid storing part of the pack partially overlaps the liquid storing part of the adjacent pack, a check is made on whether or not the liquid storing packs are arranged in predetermined arranging order within the liquid container case. Order distinguishing indicators are provided on parts of the packs, not overlapping other packs. The indicators show information concerning the predetermined arranging order of the liquid storing packs, and the arranging order of the liquid storing packs accommodated in the liquid container case is checked on the basis of the order distinguishing indicators provided on the liquid storing packs.

This way, on the basis of the order distinguishing indicators showing information concerning the predetermined arranging order of the liquid storing packs, the arranging order of the liquid storing packs accommodated in the liquid container case is checked. Therefore, the arranging order of the liquid storing packs can be efficiently confirmed.

The present disclosure relates to the subject matter contained in Japanese patent application Nos. 2003-198042 (filed on Jul. 16, 2004), 2003-428220 (filed on Dec. 24, 2003), and 2004-124249 (filed on Apr. 20, 2004), each of which is expressly incorporated herein by reference in its entirety.

DESCRIPTION OF THE PREFERRED EMBODIMENTS

First Embodiment

In the following description, explanation will be made to the first embodiment of the liquid container embodying the present invention with reference to FIGS. 1 to 7.

Figure 1:
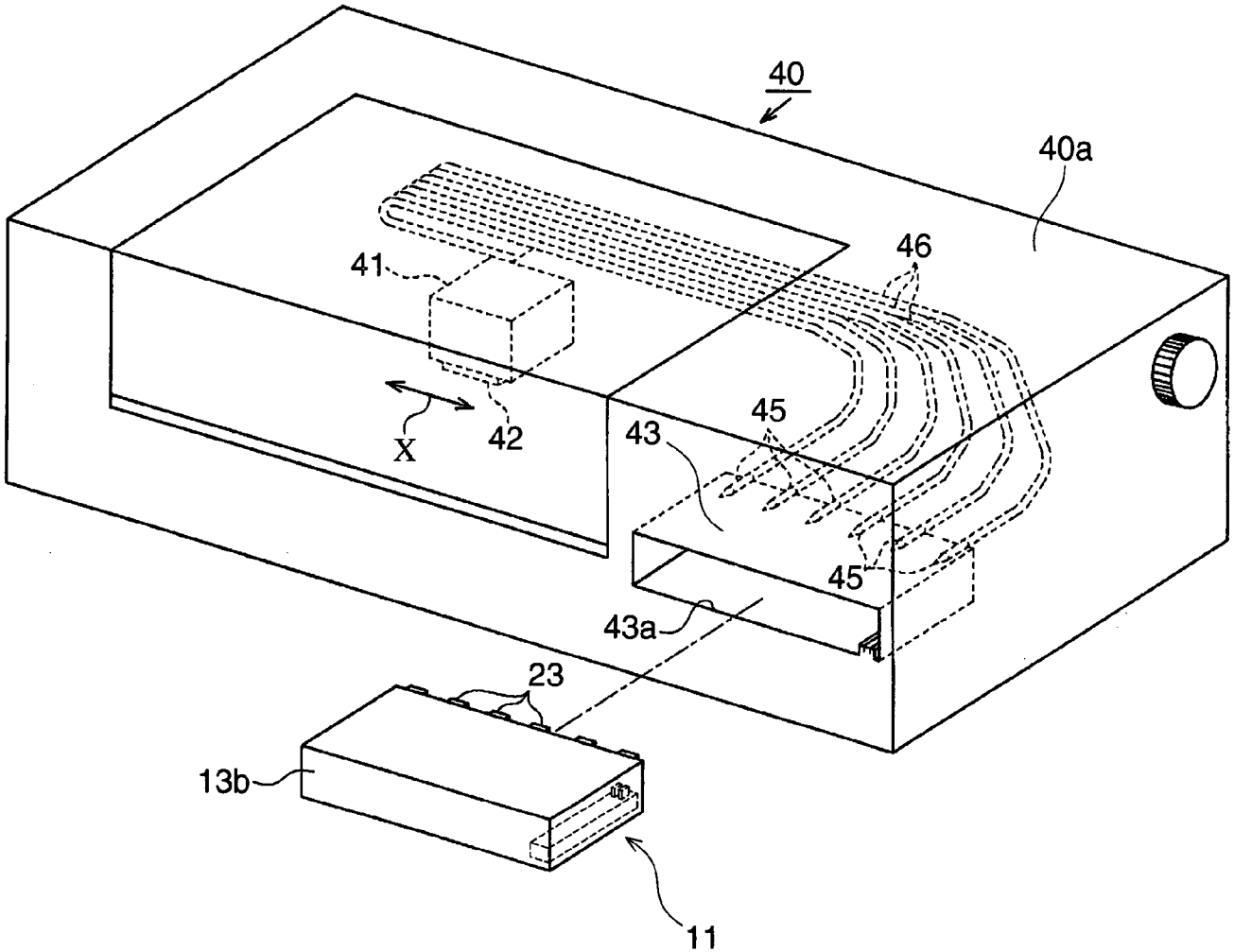
FIG. 1 is an outlined perspective view of the printer attaching an ink cartridge.

FIG. 1 is the perspective view for explaining the outline of an ink jet type recording device (called merely as "printer" hereafter) as a liquid ejecting device of the present embodiment.

As shown in FIG. 1, the printer 40 has a carriage 41 within a casing 40*a*. The carriage 41 is inserted and supported by a guide member (not shown), and reciprocates in an X direction. The carriage 41 has a recording head 42 at the lower surface thereof as a liquid ejecting head provided with nozzles of six rows (not shown). The nozzle rows have the same number as number of ink colors (kinds) used by the printer 40 corresponding to, for example, inks of black (K), cyan (C), light cyan (LC), magenta (M), light magenta (LM), and yellow (Y). The nozzle rows comprise a plurality of nozzles, and eject the inks of respectively different colors (kinds) per each of rows.

The casing 40*a* has a cartridge attaching part 43 at one side thereof. The cartridge attaching part 43 has an insertion port 43*a* for inserting an ink cartridge 11 as a liquid container, and has six pieces of supply needles 45 in opposition to the ink cartridge 11 inserted in the cartridge attaching part 43. When the ink cartridge 11 is inserted in the cartridge attaching part 43, the supply needles 45 get into the ink cartridge 11 for introducing the inks from the ink cartridge 11. The respective supply needles 45 connect six pieces of supply tubes 46 each of which communicates with each of the nozzle rows of the recording head 42.

Accordingly, when the ink cartridge 11 is inserted into the insertion port 43*a* and attached in the cartridge attaching part 43, the supply needles 45 of the cartridge attaching part 43 are inserted into ink supply ports 15*a* of ink packs 12 via a center, i.e., openings 23*c* of supporting parts 23 of the ink cartridge 11, and the supply needles 45 open valve mechanisms provided in the ink supply ports 15*a*. Thereby, the ink is supplied from the interior of the ink pack of the ink cartridge 11 to the recording head 42 of the carriage 41 via the supply needle 45 and the supply tube 46, and the ink is ejected toward a paper from the nozzles of the recording head 42 for printing. When the ink is consumed by printing, the remaining amount of the ink stored in each of the ink packs 12 is different from the original amount (when the ink is initially contained), and when the ink amount goes down, pressure in the ink pack 12 lowers. Therefore, negative pressure in the ink pack 12 for avoiding the ink from leakage more reduces in association with the ink consumption.

Figure 2:
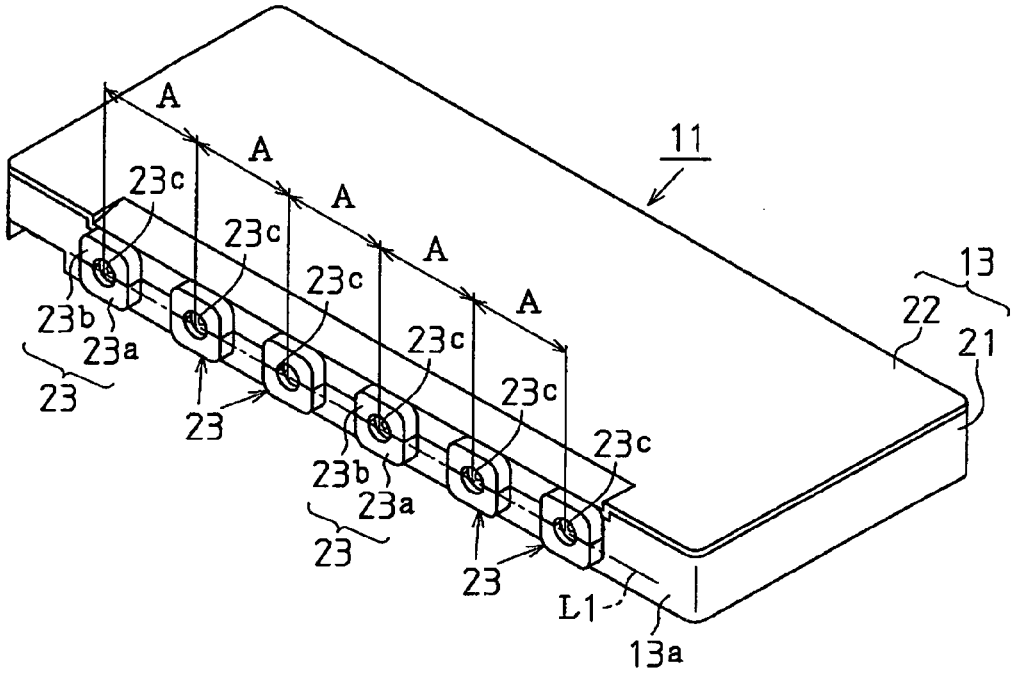
FIG. 2 is a perspective view seen from the upper side of the ink cartridge of a first embodiment.

As shown in FIG. 2, the ink cartridge 11 as the liquid container is almost rectangular parallelepiped. The ink cartridge 11 has, as shown in FIG. 4, the ink packs 12 as a plurality of liquid storing packs storing the ink as liquid and a storing case 13 as the liquid container case supporting the ink packs.

Figure 7:
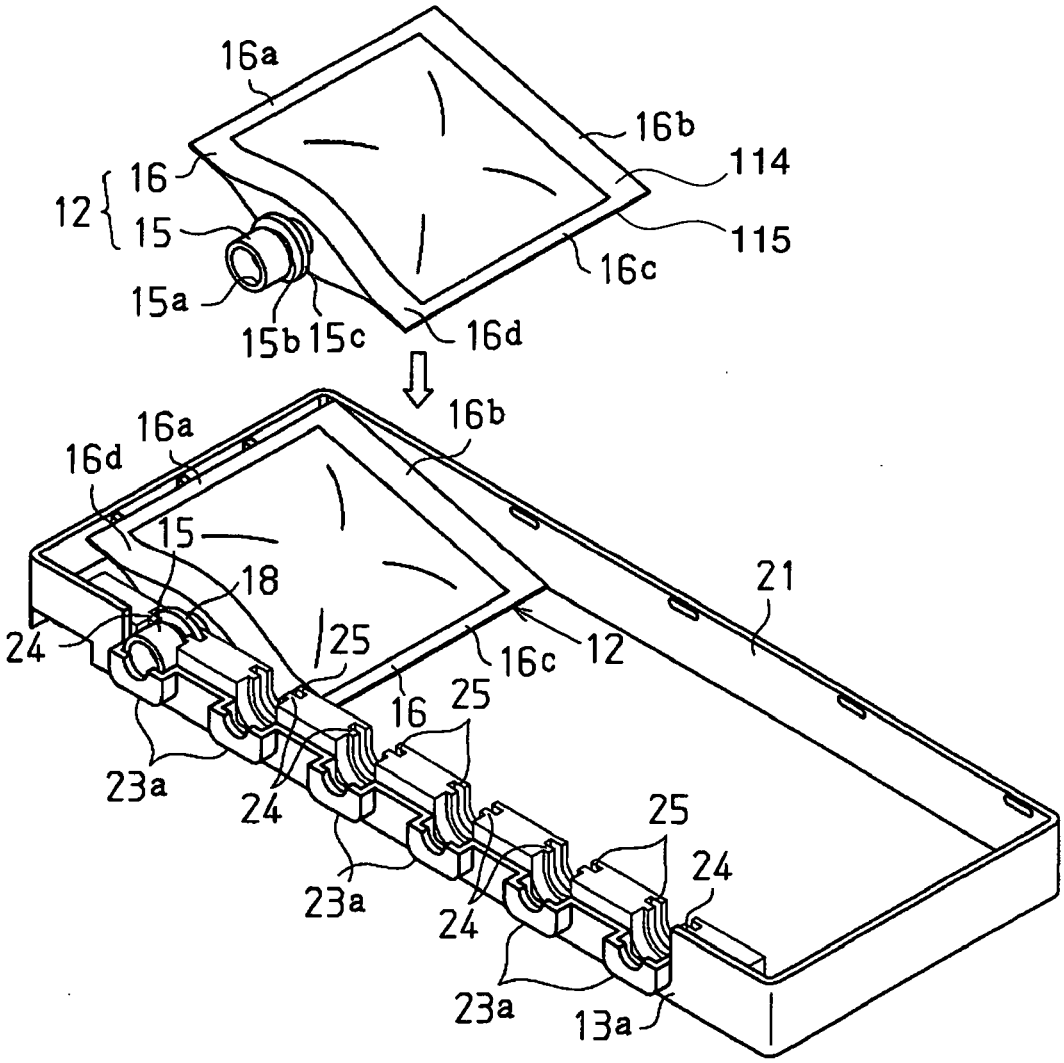
FIG. 7 is the perspective view explaining a process of setting up the ink cartridge.

The ink pack 12 is, as shown in FIG. 7, made up of a pack part 16 as a flexible bag and an ink outlet member 15 as a liquid outlet member. The pack part 16 is formed by piling two sheets of flexible laminate films 114, 115 made by evaporating aluminum on a polyethylene film having, for example, gas barrier property, and thermally welding four sides of the films 114, 115. To state in detail, the pack part 16 is formed by thermally welding three sides of the two sheets of piled laminate films 114, 115 as welding portions 16*a*, 16*b*, 16*c*, and thermally welding the remaining one side as a welding portion 16*d* under a condition that the ink outlet member 15 projects therefrom. The ink pack 12 is thereby formed to be like a soft case (so-called pillow type), and the ink is hermetically contained therein.

The ink outlet member 15 is substantially cylindrical, and the interior thereof defines an ink supply port 15*a* as a liquid outlet port. The ink stored in the ink pack 12 is taken out via the ink supply port 15*a*. Further, the ink outlet member 15 is formed almost at center with a ring-shaped groove 15*b* and a ring-shaped convex adjacent the groove 15*b*. The ink supply port 15*a* is provided with the valve mechanism (not shown) for opening only when supplying the ink so as to prevent the ink in the pack part 16 from leaking.

Figure 4:
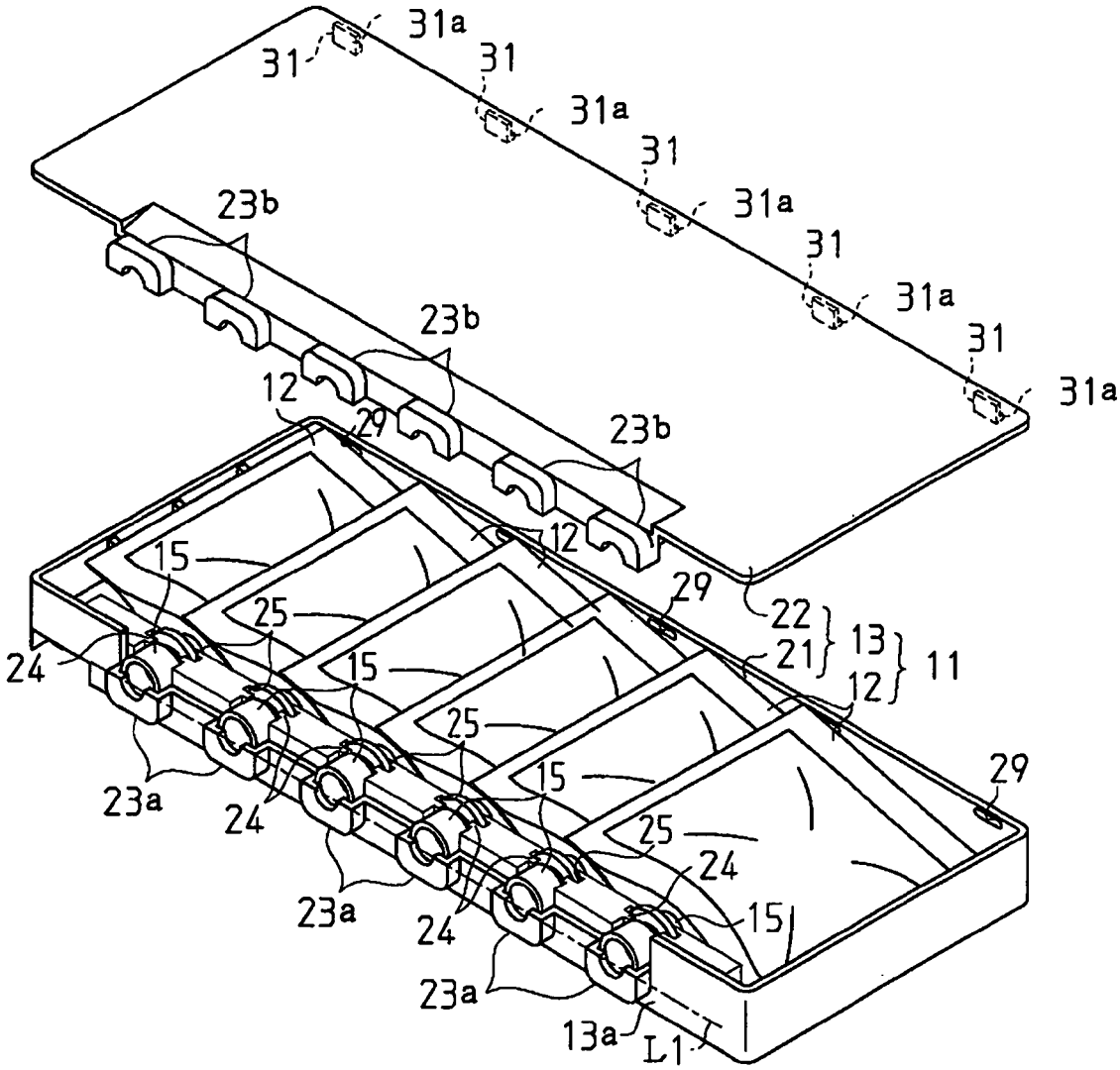
FIG. 4 is the perspective view taking off the upper case of the ink cartridge.

On the other hand, the accommodating case 13 is, as shown in FIG. 4, made up of an almost box shaped case main body 21 having an opening in the upper part and an almost plate shaped cover case 22 for covering the opening of the case main body 21.

As shown in FIG. 2, the accommodating case 13 is provided at a front face 13*a* with six supporting parts 23 equidistantly arranged by a distance A along a straight line L1 in parallel with the bottom surface of the accommodating case 13, the six supporting parts 23 being the same number as the ink packs 12 to be accommodated. These supporting parts 23 are furnished almost at the center of the case main body 21, and have opening parts 23*c* at the center thereof. As shown in FIG. 4, the supporting parts 23 have lower side supporting portions 23*a* forming their lower halves in the case main body 21, and have upper side supporting portions 23*b* forming their upper halves in the cover case 22. The supporting parts 23 support the ink outlet members 15 of the respective ink packs 12. Accordingly, the supporting parts 23 are constructed by interfacing the lower and upper side supporting portions 23*a*, 23*b* after attaching the cover case 22 under a condition that the ink outlet members 15 of the ink packs 12 are supported to the lower side supporting portions 23*a* of the case main body 21.

Figure 5:
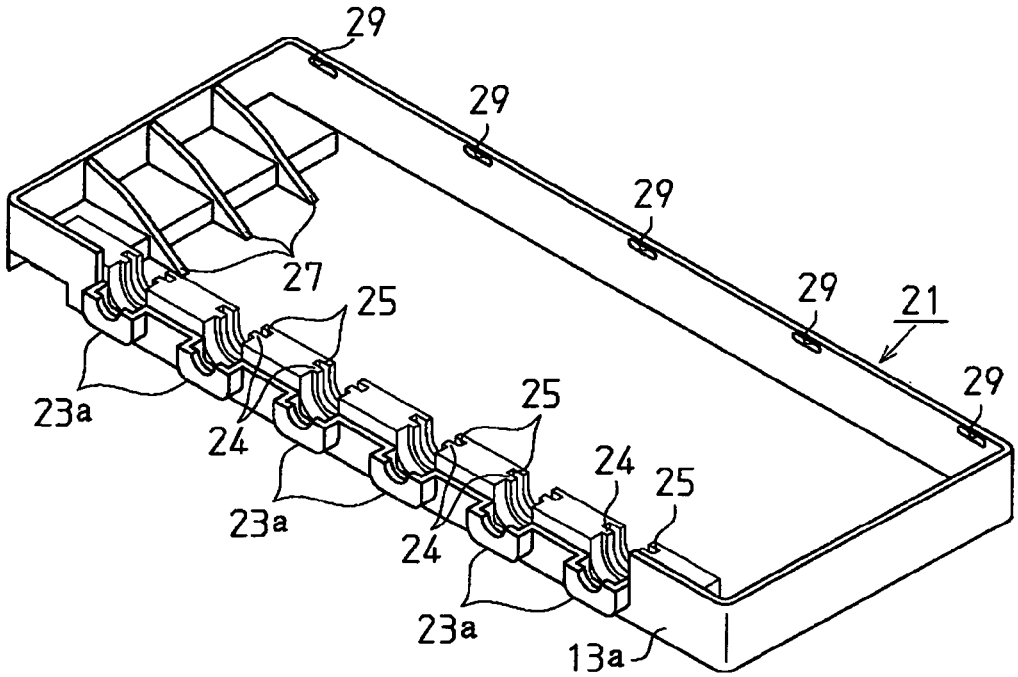
FIG. 5 is the perspective view of the lower case of the ink cartridge.

As shown in FIG. 5, the lower side portions 23*a* are formed with half arc shaped convexes 24 and half arc shaped grooves 25 which are engaged with the grooves 15*b* and the convexes 15*c* of the ink outlet members 15. The upper side supporting portions 23*b* are provided with convexes and grooves (both not shown) similarly to the lower side supporting portions 23*a*. Therefore, when the ink outlet members 15 of the ink packs 12 are supported by the lower side and upper side supporting portions 23*a*, 23*b*, the ink packs 12 are accommodated in the ink cartridge 11, not moving back-forth and right-left.

Figure 6:
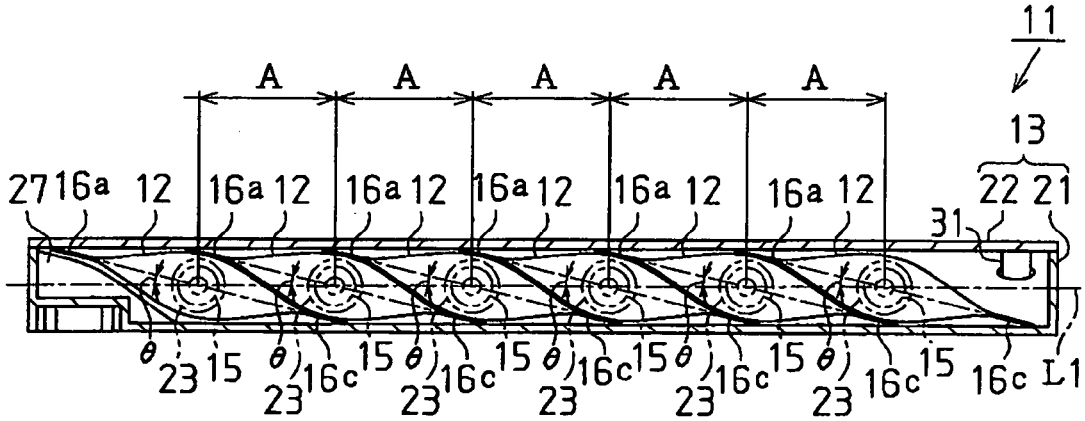
FIG. 6 is a schematically front view of the ink cartridge.

As shown in FIG. 5, at the left inside of the case main body 21, three ribs 27 serving as a posture keeping device for keeping postures of the ink packs 12 are furnished in parallel with a front face 13*a*. Accordingly, as shown in FIG. 6, the most left-handed ink pack 12 is arranged following these ribs 27, whereby the ink pack 12 keeps the posture tilting at an angle θ (in the present embodiment, θ=15°) with respect to the straight line L1 (and the bottom of the accommodating case 13) connecting the respective supporting portions 23. Since supporting portions 23 are provided almost at half in height of the case main body 21, the ink packs 12 contact the cover case 22 at the welded parts 16*a* thereof in the posture tilting at the angle θ, and the welded parts 16*b* contact the bottom of the case main body 21. Further, at a back face 13*b* of the case main body 21, engaging holes 29 are formed for engaging the cover case 22.

On the other hand, as shown in FIG. 4, the cover case 22 is formed with engaging projections 31 having projecting portions 31*a* toward the back face 13*b*.

Figure 12:
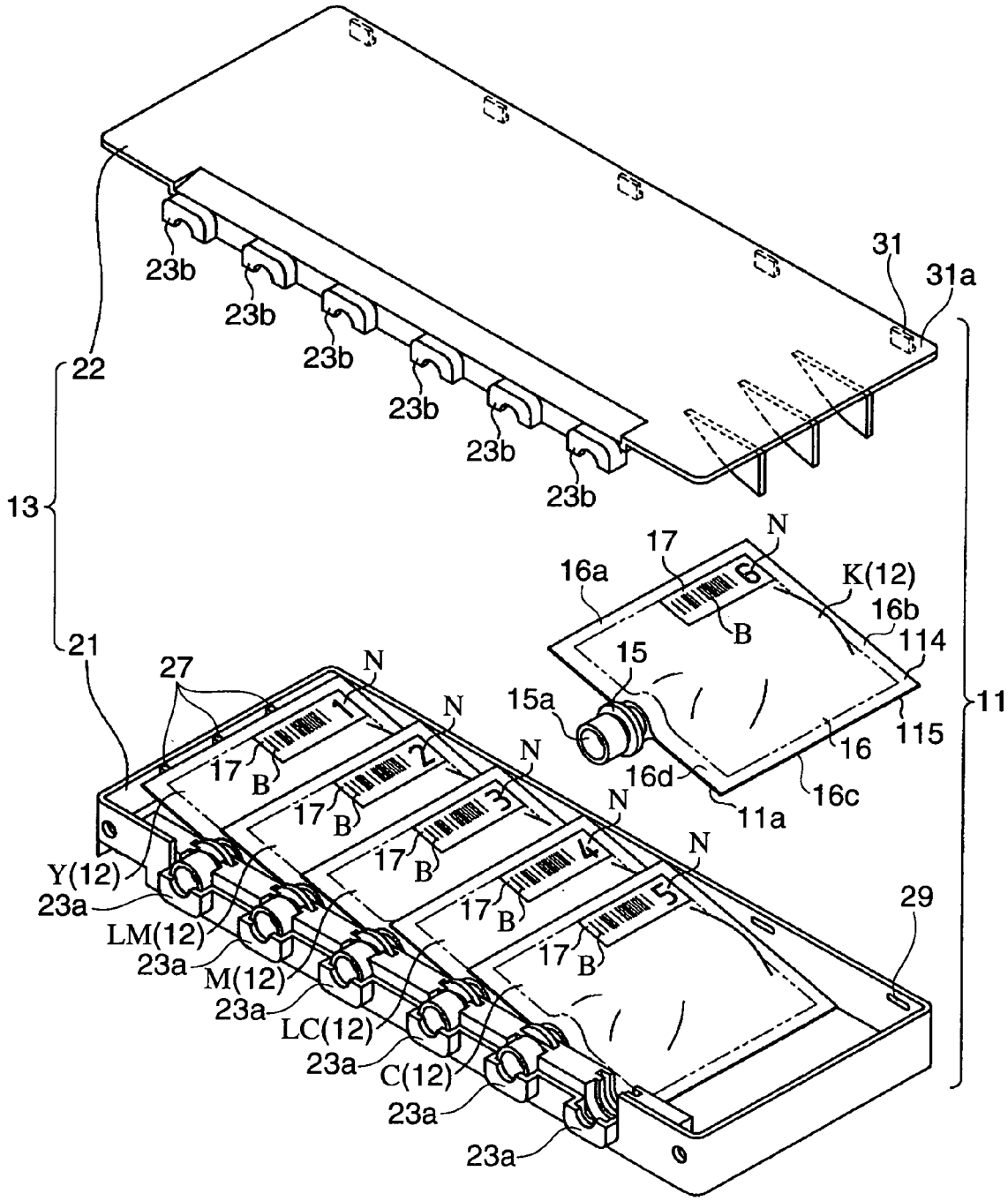
FIG. 12 is the disassembled perspective view of the ink cartridge of the fourth embodiment.

The projecting portions 31*a* are fitted in the engaging holes 29 of the case main body 21 for the cover case 22 to be fixedly secured to the case main body 21. In addition, as shown in FIG. 12, a cover case 22 may also have the ribs as the posture keeping device.

The ink cartridge 11 of the present embodiment accommodates therein the six ink packs 12 of the same shape which respectively have six colors of black, yellow, magenta, light magenta, cyan, and light cyan. This embodiment reduces pressure differential between the ink packs 12 by differing the amounts of the inks stored in the ink packs 12. When storing the inks in the ink packs 12, the amounts of the inks to be stored are not even but divided into three levels in response to using frequencies, and any of these amounts is selected to store the ink. In the embodiment, the amounts of black and light cyan of the highest using frequencies are most (the level 1), the amounts of light magenta and yellow of the higher using frequencies are more (the level 2), and the amounts of cyan and magenta of the lowest using frequencies are least (the level 3).

Further, this embodiment decides the arrangement of the ink packs 12 within the accommodating case 13, thereby to reduce pressure differential between the ink packs 12. More specifically, when arranging the ink packs 12 in the accommodating case 13, the ink packs 12 of black and light cyan of the level 1 (the most amount) are placed at both ends, and the ink packs 12 of light magenta and yellow of the level 2 are placed at the adjacent insides. Cyan and magenta of the level 3 (the least amount) are mounted at the remaining most insides (the center of arrangement). In short, the ink packs 12 storing the more amount of the ink are arranged at the outer side of arrangement, and the ink packs 12 storing the lesser amount of the ink are arranged at the center of arrangement. By the way, when the ink packs 12 to be mounted are an odd number, the present description calls one of the most inside of arrangement as the center of arrangement, and when the ink packs 12 to be mounted are an even number, two of the most inside of arrangement are called as the center of arrangement.

The ink packs 12 are mounted in the accommodating case 13 in an order stated in detail as follows, during assembly of the ink cartridge 11.

As shown in FIG. 7, at the most left side of the case main body 21, the ink pack 12 (for example, black) as the level 1 of the stored ink amount is placed. That is, the ink pack 12 is fitted to the lower side supporting part 23*a* of the most left side of the case main body 21, and is mounted in the case main body 21. The ink pack 12 is tilted at the predetermined angle θ.

Next, the ink pack 12 (for example, light magenta) as the level 2 of the stored ink amount is mounted in the case main body 21 under a condition that the ink outlet member 15 is fitted to the lower side supporting portion 23*a* at the second from the left. The ink pack 12 is tilted in almost the same posture as the ink pack 12 which has been previously accommodated. Then, the welded part 16*a* at the end side of the mounted ink pack 12 is placed at the center part most expanded of the pack part 16 of the previously accommodated ink pack 12. That is, as shown in FIG. 6, each of the ink packs 12 is arranged such that its about half part overlaps an about half of the adjacent ink pack 12. In short, the ink storing ranges of the ink packs mutually overlap.

Thereafter, in the same manner, the ink pack 12 is placed such that the lower side supporting portion 23*a* of the third (the center of arrangement) from the left supports the ink outlet member 15 of the ink pack 12 (for example, cyan) as the level 3 of the stored ink amount. Subsequently, the ink pack 12 is placed such that the lower side supporting portion 23*a* of the fourth (the center of arrangement) from the left supports the ink outlet member 15 of the ink pack 12 (for example, magenta) as the level 3 of the stored ink amount. Further, in the same manner, the ink pack 12 (for example, yellow) as the level 2 of the stored ink amount is placed at the fifth from the left. Finally, as shown in FIG. 4, at the lower side supporting portion 23*a* of the most right side, the ink pack 12 (light cyan) is placed at the lower side supporting portion 23*a* in a manner of supporting the ink outlet member 15 of the ink pack 12 as the level 1 of the stored ink amount.

As the present embodiment, it has been proved by the experiment that in case the plurality of ink packs 12 are arranged in the manner of partially overlapping the adjacent ink packs 12, the ink packs 12 placing at the inside are given more influence from both sides, and pressure within the ink packs 12 is made higher. On the other hand, the more is the ink amount, the higher is the internal pressure of the ink pack 12. Therefore, by arranging the ink packs 12 as mentioned above in accordance with the ink amount, it is possible to reduce pressure differential caused by the mounting positions of the respective ink packs 12.

Figure 3:
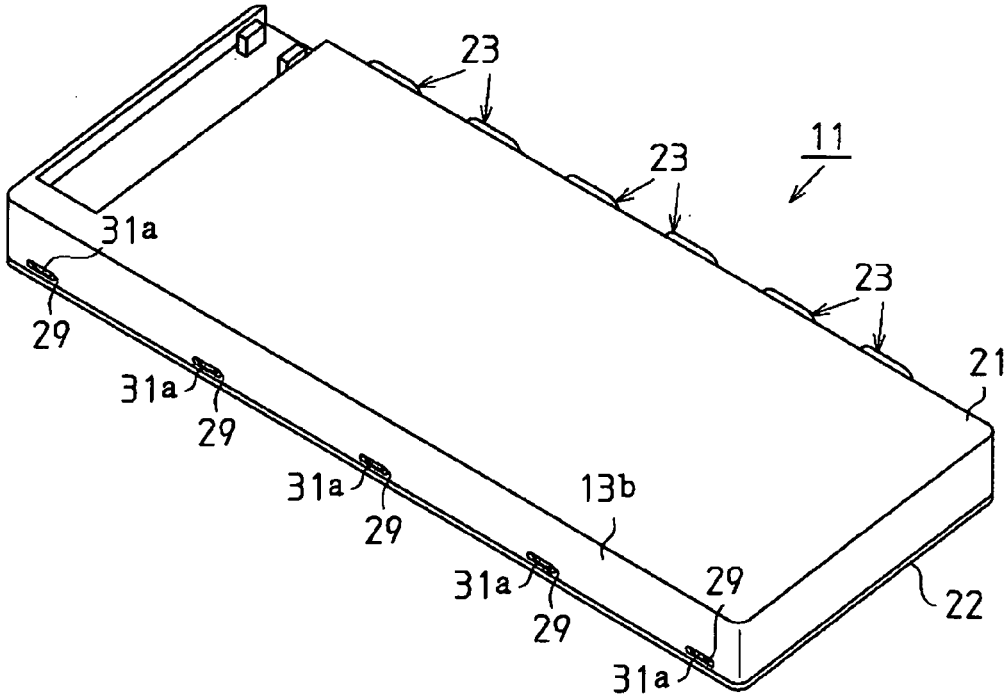
FIG. 3 is the perspective view seen from the lower side of the ink cartridge of FIG. 2.

The six ink packs 12 are all stored in the case main body 21 as seen in FIG. 4, followed by engaging the engaging projections 31 of the cover case 22 into the engaging holes 29 of the case main body 21, and the cover case 22 is attached to the case main body 21 for covering the opening of the case main body 21. At this time, the six ink outlet members 15 are supported such that the center axes of the respective ink supply ports 15*a* are arrayed on the horizontal plane including the straight line L1. As having above explained, the ink cartridge 11 is assembled as shown in FIGS. 2 and 3.

According to the above mentioned embodiment, the following effects are brought about.

(1) In the present embodiment, with respect to the ink cartridge 11 efficiently arranging and accommodating the plurality of the ink packs 12, the more amount of the ink stored in the ink packs 12 are placed at both end sides, and the lesser amount of the ink stored in the ink packs 12 are placed closer to the center. In short, the ink packs 12 storing the more amount of the ink and having the higher internal pressure are arranged at the outer side of arrangement of small influence effected by pressure from both sides, and the ink packs 12 storing the less amount of the ink and having the lower internal pressure are arranged at the center of arrangement of large influence effected by pressure from both sides. Thus, pressure differential of the inks stored in the respective ink packs 12 can be reduced.

(2) In the present embodiment, since pressure differential of the inks stored in the respective ink packs 12 can be reduced, the ink does not leak out from the nozzle of the recording head 42, while difference in height between the nozzle and the ink cartridge 11 can be restrained to the minimum. Accordingly, the ink cartridge 11 and the printer can be reduced in size.

(3) In the present embodiment, since the ink pack 12 is formed by thermally bonding the four sides of the two sheets of the flexible films, the ink pack 12 becomes spindle-shaped most expanded in the center part thereof under the condition that the ink is stored therein. Accordingly, by overlapping the side end of the adjacent ink pack 12 on the expanded center part of the ink pack 12, the plurality of ink packs 12 can be efficiently accommodated. As a result, the ink cartridge 11 can be reduced in size and in turn the printer 40 equipping the ink cartridge 11 can be miniaturized.

(4) In the present embodiment, with respect to the ink cartridge 11, as shown in FIG. 6, the center axes of the ink supply ports 15*a* of the ink packs 12 are disposed on the horizontal plane including the straight line L1, so that the ink supply ports 15*a* are arranged at the same height. Therefore, the liquid surfaces of the respective ink packs 12 can be equal in height. Consequently, pressure of the inks stored in the ink packs 12 can be almost equal.

(5) In the present embodiment, the ink pack 12 accommodated in the ink cartridge 11 is tilted at the predetermined angle θ with respect to the accommodating case 13. Accordingly, by overlapping the side end of the adjacent ink pack 12 (the welded portions 16*a*, 16*c*) on the expanded center part of the ink pack 12, the ink packs 12 can be efficiently accommodated. Thus, the ink cartridge 11 can be reduced in size and in turn the printer 40 equipping the ink cartridge 11 can be miniaturized.

(6) In the present embodiment, the ribs 27 are furnished in the case main body 21. The ink pack 12 firstly accommodated in the ink cartridge 11 keeps the tilted posture by the ribs 27. The subsequent ink pack 12 keeps the tilted posture by the precedent ink pack 12. Thereby, each of the ink packs 12 can keep tilted posture at the predetermined angle θ, not disordering the posture, and pressure of the inks stored in the ink packs 12 can be uniform.

Second Embodiment

Next, explanation will be made to a second embodiment of the invention with reference to FIGS. 8 and 9. The similar parts to those of the first embodiment will be given the same numerals and marks for omitting detailed explanation.

Figure 8:
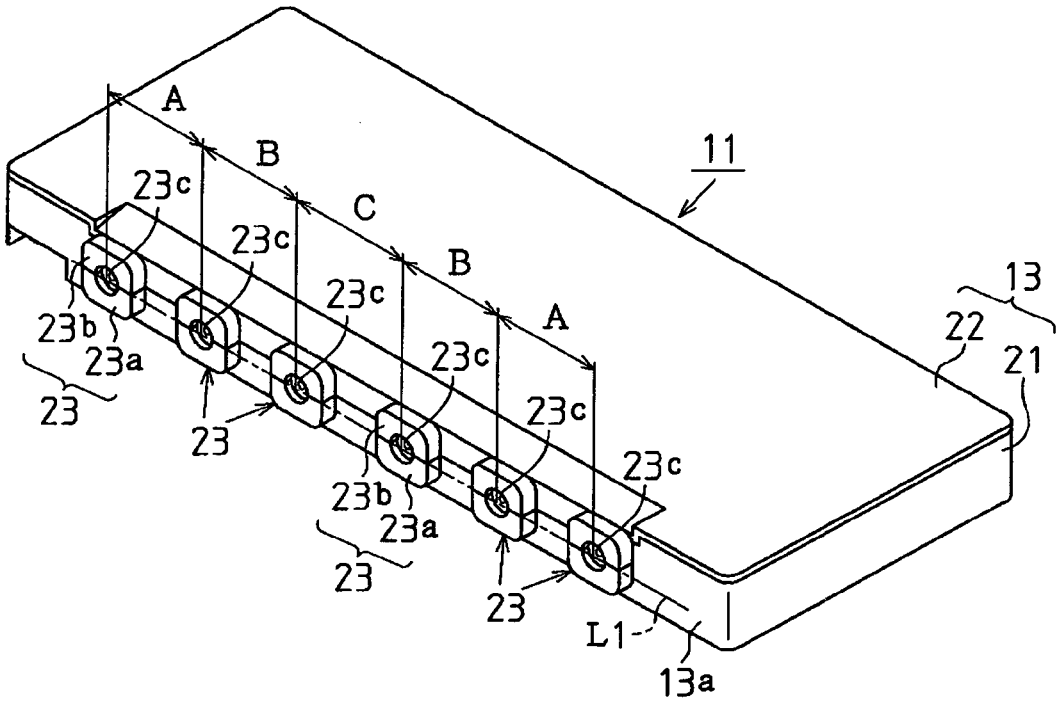
FIG. 8 is the perspective view seen from the upper side of the ink cartridge of a second embodiment.
Figure 9:
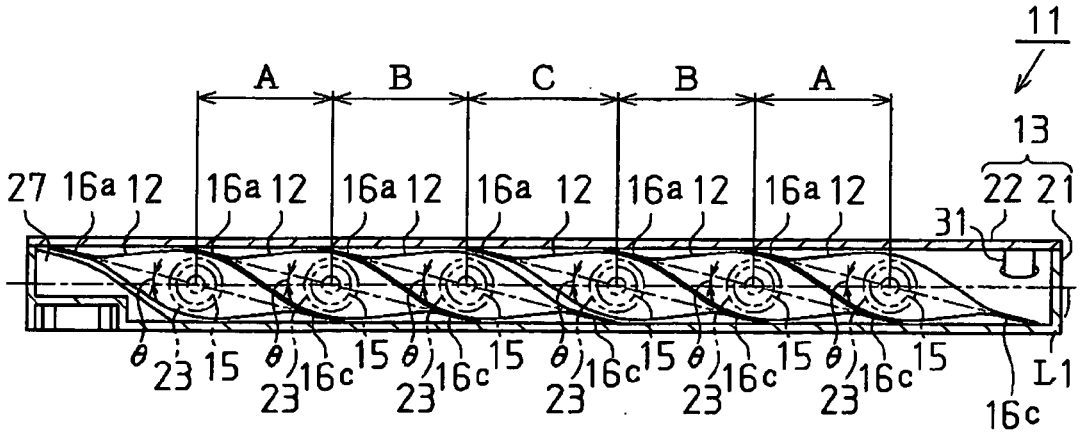
FIG. 9 is the schematically front view of the ink cartridge of the second embodiment.

As shown in FIG. 8, the accommodating case 13 is provided at a front face 13*a* with six supporting parts 23 along a straight line L1 in parallel with the bottom surface of the accommodating case 13, the six supporting parts 23 being the same number as the ink packs 12 to be accommodated. These supporting parts 23 are furnished almost at the center of the case main body 21, and have opening parts 23*c* at the center thereof. Further, as shown in FIG. 9, when the ink outlet members 15 are supported by the supporting parts 23, about half of the ink pack 12 overlaps on about half of the adjacent ink pack 12.

In the present embodiment, spaces between these six supporting parts 23 are not equidistant, and the spaces A, B, C become slightly wider as going to the center. That is, the center space C is wider than the outside spaces B, and the spaces B are wider than both end spaces A.

Therefore, the ink packs 12 closer to the center become narrower in the overlapping ranges on the adjacent ink packs 12. That is, in this embodiment, pressure differential between the ink packs 12 is decreased by adjusting the overlapping areas on the adjacent ink packs 12.

As mentioned above, it has been proved by the experiment that in case the plurality of ink packs 12 are arranged in the manner of partially overlapping the adjacent ink pack 12, the ink pack 12 placing at the inner side is given more influence from both sides, and pressure within the ink pack 12 becomes higher. On the other hand, the experiment has also proved that if making the spaces A, B, C as seen in FIG. 9, the influences from both sides are weakened, and pressure of the inks stored in the respective ink packs 12 is made more uniform.

Besides, the inks of six colors are stored in the six ink packs 12 of the same shape to be accommodated in the ink cartridge 11. Also in the present embodiment, the amounts of the inks stored in the ink packs 12 are not even, but divided into the three levels, and the ink pack 12 storing the much amount of the ink is placed outside, while the ink pack 12 storing the less amount of the ink is placed inside.

According to the above mentioned embodiment, the following effects can be brought about.

In comparison with the ink packs 12 at both sides, the inside ink pack 12 is more separate from the adjacent ink pack 12, so that influence of pressure by the outside ink pack 12 can be lessened. Therefore, pressure differential within the respective ink packs 12 can be made smaller.

Third Embodiment

In the above mentioned first and second embodiments, the ink amounts stored in the six ink packs 12 are divided into the three levels, but may be divided into two or four levels. In the above mentioned first and second embodiments, the inks stored in the six ink packs 12 are black, yellow, magenta, light magenta, cyan, and light cyan, and other colors are also sufficient.

The third embodiment utilizes the ink cartridge 11 of the first embodiment for storing respectively the inks of black, yellow, magenta, cyan, red, and violet (blue) in the six ink packs 12. The six ink packs 12 of the same shape storing respectively the inks of yellow, magenta, black, red, cyan, and violet (blue) are arranged and accommodated in this order. Herein, when storing the inks into the respective ink packs 12, the ink amounts are not even, but stored at the six levels in response to the using frequencies. More specifically, the amount of the ink pack storing the cyan ink is most (level 1), the amount of the ink pack storing the magenta ink is next (level 2), the amount of the ink pack storing the black ink is third (level 3), the amount of the ink pack storing the yellow ink is fourth (level 4), the amount of the ink pack storing the violet (blue) ink is fifth (level 5), and the amount of the ink pack storing the red ink is least (level 6). In this cartridge, the ink pack storing the red ink of the least amount is place at the center, and at the same time, the ink pack storing the cyan ink of the most amount is placed at the position other than the center, so that it is possible to reduce influences of pressure between the ink packs.

Fourth Embodiment

Figure 10:
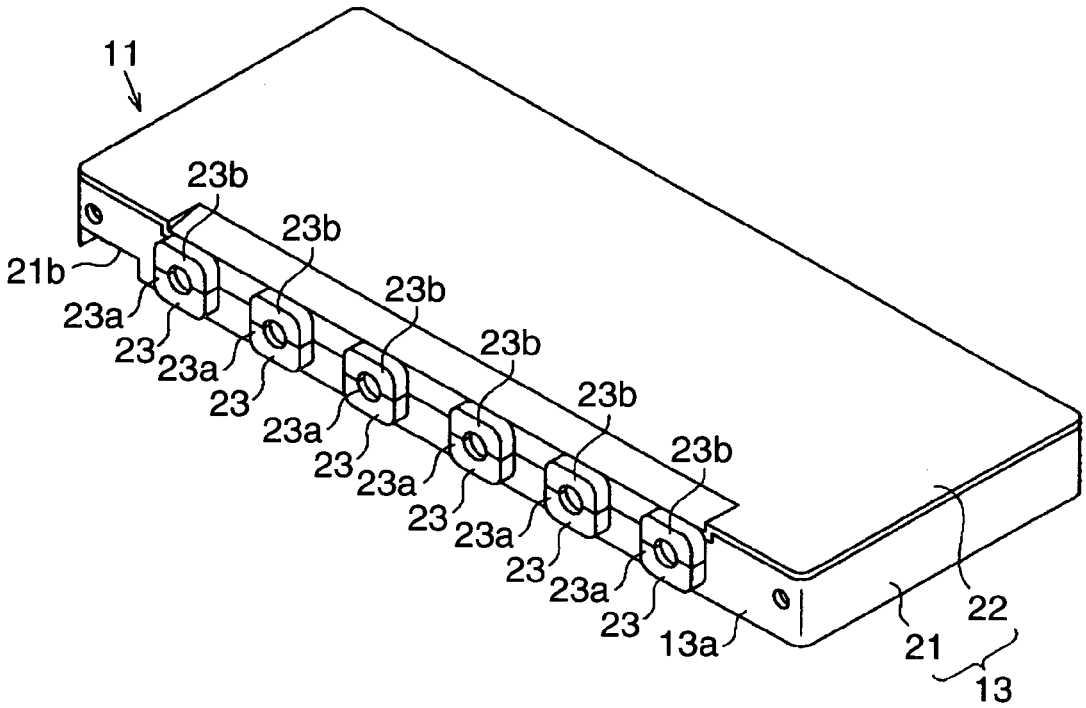
FIG. 10 is the perspective view of the ink cartridge (a fourth embodiment) to be attached to the printer of FIG. 1.

A fourth embodiment of the invention will be explained, referring to the ink cartridge 11 shown in FIGS. 10 to 13. As shown in FIG. 10, the ink cartridge 11 has an almost rectangular parallelepiped case 13. With in the case 13, as shown in FIG. 12, the ink packs K, C, LC, M, LM, and Y as the plurality of liquid storing packs are accommodated. By the way, if not distinguishing the ink packs K, C, LC, M, LM, and Y, the present embodiment will call them as the ink pack(s) 12.

At first, the ink pack 12 will be referred to. The ink pack 12 is, as shown in FIG. 12, made up of the outlet member 15 as the outlet part, and the pack part 16 communicating with the outlet member 15 and the pack part 16 as the liquid storing pack. The pack part 16 is formed by thermally welding the four sides of the film members 114, 115 having gas barrier property and flexibility. To state in detail, the pack part 16 is made up of, for example, the film members 114, 115, each having the gas barrier layer and thermoplastic resin layer, and three sides are thermally welded under a condition that the thermoplastic layers of the film members 114, 115 are opposed to each other, to form a bag shape. The remaining one side is thermally deposited such that the outlet member 15 projects therefrom, and the interior is tightly sealed. The respective ink packs K, C, LC, M, LM, and Y store in the pack parts 16 the inks of black, cyan, light cyan, magenta, light magenta, and yellow.

The outlet member 15 is substantially cylindrical, and is formed with the ink supply port 15*a*. If the above mentioned supply needle 45 gets into the ink supply port 15*a*, the ink stored in the ink pack 12 can be discharged.

The pack part 16 is pasted on the upper face with a label 17. More specifically, the label is pasted on the upper face of the pack part 16 and at the end portion of the left side with respect to the front face 11*a* of the ink pack 12 provided with the outlet member 15. The label 17 shows the bar-code B as the second order distinguishing indicator. The bar-codes B show attribute information of the inks such as the amounts, colors (kinds) of the inks stored in the respective ink packs 12, lot numbers, dye inks or pigment inks in terms of numerically expressed data. Further, the bar-codes B show the data concerning the arranging order of the respective ink packs within the case 13 in terms of numerically expressed data.

The labels 17 show, in adjacency of the bar-code B, numbers N as the first order distinguishing indicators and indications for visual recognition. The number N shows the overlapping order (arranging order) of the ink packs 12 at visible sizes. The ink pack Y storing the yellow ink shows the number N of "1", and the ink pack LM storing the light magenta ink shows the number N of "2". Similarly, the labels 17 of the ink packs M, LC, C, and K storing the magenta, light cyan, cyan, and black inks show the number N of "3", the number N of "4", the number N of "5", and the number N of "6", respectively.

Figure 11:
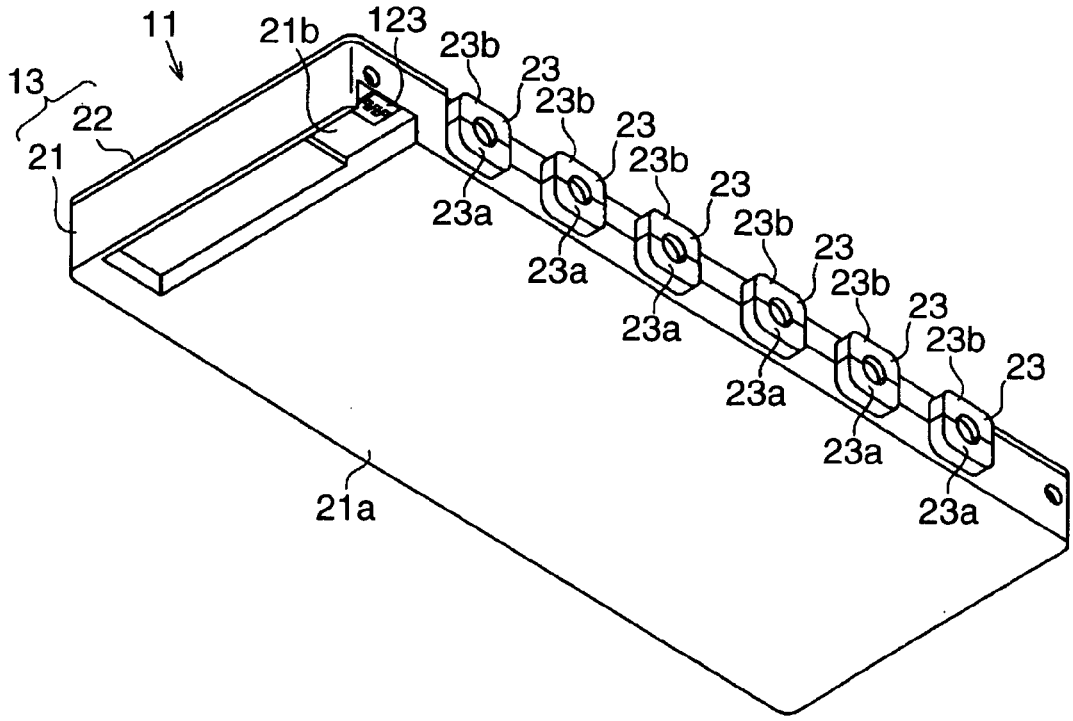
FIG. 11 is the perspective view of the ink cartridge of the fourth embodiment.

As shown in FIG. 11, the main body 21 is furnished with accommodating concave part 21*b* at one side of a bottom 21*a*. The accommodating concave part 21*b* is provided with a circuit board 123 having a memory element (not shown) which stores the number of the ink packs 12 accommodated in the case 13, or attribute information of the cartridge such as colors or kinds.

The main body 21 of the case 10 stores the respective ink packs 12 overlapping one another as shown in FIG. 12. To state in detail, the ink packs 12 are stored therein under the condition that one part of the pack part 16 of the ink pack 12 overlaps on one part of the pack part 16 of the adjacent ink pack 12. For example, at the left end in FIG. 12 of the main body 21, the ink pack Y of the yellow ink is positioned by fitting the outlet member 15 in a supporting part 23*a* at a lower side of a left end. Adjacent to the ink pack Y, the ink pack LM of the light magenta ink is mounted. The ink pack LM is positioned such that the outlet member 15 is fitted in the lower side supporting part 23*a* being second from the left end. As a result, the ink pack LM is fixedly supported on the upper face of the pack part 16 of the ink pack Y, leaving the range not overlapping.

Further, in order from adjacency of the ink pack LM, the ink pack M of the magenta ink, the ink pack LC of the light cyan ink, the ink pack C of the cyan ink, and the ink pack K of the black ink overlap on the respective left-adjacent ink packs 12, leaving the ranges not overlapping. In short, the arranging order (placing order or stacking order) of overlapping the respective ink packs 12 in the case main body 21 is, in order from adjacency of the left end, yellow, light magenta, magenta, light cyan, cyan, and black, and the ink pack Y of the yellow ink is at the lowermost layer, and the ink pack K of the black ink is at the uppermost layer. With this arrangement, the space within the case 13 is usefully used to decrease the dead space.

When arranging all the ink packs 12 in the above mentioned order, the numbers N shown in the labels 17 of the six ink packs 12 are continuous as shown in FIG. 12, and the order of 1 to 6 goes from the ink pack Y of the lowermost layer toward the ink pack K of the uppermost layer. The bar-codes B pasted to the labels 17 of the ink packs Y, LM, M, LC, C, and K show the arranging order in terms of numerically expressed data. For example, the bar-code B of the ink pack Y of the yellow ink arranged to the left end shows the data of "First" in terms of numerically expressed data, and the bar-code B of the ink pack LM of the light magenta ink being the second from the left end shows the data of "Second" in terms of numerically expressed data.

Next, further explanation will be made to a setting-up process of the ink cartridge 11. At first, the ink pack Y of "1" in the number N of the label 17 is attached by fitting the outlet member 15 thereof to the lower side supporting part 23*a* at the left end of the main body 21. The face pasted with the label 17 of the ink pack Y faces upward. Continuously, the ink pack LM of "2" in the number N of the label 17 is attached by fitting the outlet member 15 thereof to the lower side supporting part 23*a* of the second from the left end. At this time, the ink pack LM is positioned by the lower side supporting part 23*a*, and the end part of the ink pack LM overlaps on the ink pack Y of the left end. The label 17 of the previously accommodated ink pack Y does not hide but is seen.

Thereafter, similarly, the ink pack M of "3" in the number N of the label 17 is attached by fitting the outlet member 15 thereof to the lower side supporting part 23*a* of the third from the left end. Further, the ink pack LC of "4" in the number N of the label 17 is attached by fitting the outlet member 15 thereof to the lower side supporting part 23*a* of the fourth from the left end. The ink pack C of "5" in the number N of the label 17 is attached by fitting the outlet member 15 thereof to the lower side supporting part 23*a* of the fifth from the left end of the main body 21. Further, the ink pack K of "6" in the number N of the label 17 is attached by fitting the outlet member 15 thereof to the lower side supporting part 23*a* of the sixth from the left end of the main body 21.

When all of the six ink packs 12 are supported in the main body 21, the labels 17 of the respective ink packs 12 are all in a row and visually recognized. Thus, a first checking process is carried out, and whether or not the different six kinds of the ink packs 12 are accommodated in the main body 21 in the right order (the arranging order) is confirmed by visually recognizing whether or not the respective numbers N are continuous. In case the respective numbers N are not continuous, the respective ink packs 12 are re-placed and accommodated in the main body so that numbers N are continuous. A second checking process is carried out continuously from the first checking process.

Figure 13:
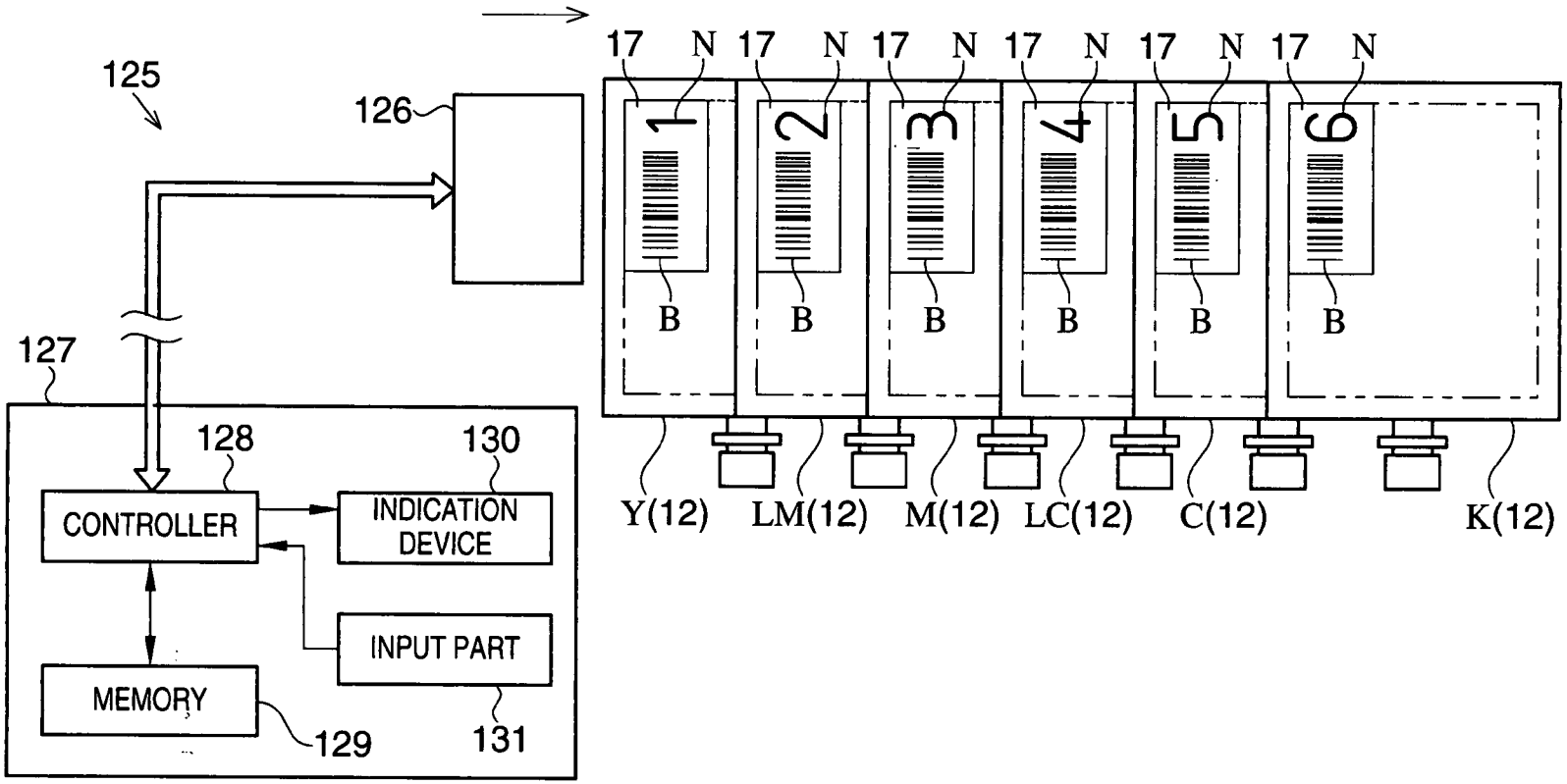
FIG. 13 is a view for explaining a checking method of the ink cartridge of the fourth embodiment.

The second checking process will be explained with reference to FIG. 13. FIG. 13 is an explanatory view for explaining the second checking process, and the main body 21 for accommodating the ink packs 12 are omitted from the drawing. In the second checking process, a checking device 125 is used. The checking device 125 has a bar-code reader 126 and a management terminal 127. The bar-code reader 126 is supported by a moving instrument (not shown) to be movable on and along the bar-codes B of the labels 17 pasted on the ink packs 12, reads each of the car-codes B, and sends the read information to the management terminal 127. The management terminal 127 has a controller 128 and a memory 129. The controller 128 is connected to the bar-code reader 126, and receives data read by the bar-code reader 126. The memory 129 stores various kinds of programs for confirming the arranging order of the ink packs 12. The controller 128 is connected to an indication device 130 such as a display, and an input part 131 such as key board.

In the second checking process, the bar-code reader 126 is moved from the left end of the main body 21 in an arrow direction in the drawing by the moving instrument under the condition that the ink packs 21 are accommodated in the main body 21.

The bar-code reader 126 moves on and along the labels 17 pasted on the ink packs 12, reads the bar-codes B of the labels 17, and sends the read data to the management terminal 127. The controller 128 of the management terminal 127 receives the sent data, and extracts data concerning the arranging order from the sent data. Further, the controller 128 follows the programs installed in the memory 129 and judges whether or not the data concerning the read arranging order agree with the predetermined arranging order.

In case the arranging order read by the bar-code reader 126 do not agree with the predetermined arranging order, the controller 128 issues an error output instruction for the display 130 to output an error indication. By the error indication output on the display 130, the ink pack 12 of wrong order can be replaced to the right order.

On the other hand, in case the arranging order read by the bar-code reader 126 agree with the predetermined arranging order (disposing order), the controller 128 sends to a writing instrument (not shown) an instruction of progressing to a writing process. Moving to the writing process, the writing instrument causes the memory element of the circuit board 123 provided on the bottom 21*a* of the main body 21 to store the ink attribute information of the respective ink packs 12. In short, the writing process cannot be executed unless the controller 123 sends the instruction of progressing to the writing process.

According to the fourth embodiment, the following effects are brought about.

(1) The above mentioned embodiment accommodates the ink packs 12 within the case 13 of the ink cartridge 11 in the predetermined order such that the ink pack 12 partially overlap the adjacent ink pack 12 in order to reduce the dead space. The label 17 is pasted on the range of not overlapping the adjacent ink pack 12 of the pack part 16 of the ink pack 12. The label 17 indicates the bar-code B readable by the bar-code reader 126 and converted from the ink attribute information and the arranging order of the ink pack 12, and also indicates the number N showing the arranging order (the disposing order).

Therefore, when the ink packs 12 are accommodated within the case 13, the ink packs 12 can be accommodated within the case 13 simply in accordance with the order of the number N shown on the labels 17 of the ink packs 12. Since the continuous numbers N in accordance with the arranging order are shown on the labels 17 of the ink packs 12, by visually recognizing whether or not the numbers N of the six ink packs 12 accommodated in the main body 21 are continuous, it is possible to confirm whether or not the ink packs 12 are arranged in the predetermined order. Thus, it is possible to prevent the ink packs 12 from being accommodated in the wrong order.

Since the label 17 shows the bar-code B converted from the arranging order of the ink packs 12, the bar-code reader 126 can read the bar-code B of the six ink packs 12 accommodated in the main body 21 to confirm whether or not the ink packs 12 are arranged in the predetermined order. Even if the ink packs 12 are accommodated in the wrong order, this error can be detected by the check device 125 connected to the bar-code reader 126 so that the error notification can be output. Therefore, the checking can be efficiently performed. Besides, since the number N and the bar-code B are both shown on the label 7, the arranging order of the ink pack 12 can be twice confirmed, so that the ink pack 12 can be avoided from being accommodated in the wrong order.

(2) In the above mentioned embodiment, information shown in the label 17 of the ink pack 12 and readable by the reading device is in the form of the bar-code B. Therefore, the arranging order of the ink packs 12 can be read at high precision through an easy operation.

The fourth embodiment may be modified as follows.

In the above mentioned embodiment, one label 17 pasted on the ink pack 12 shows the number N and the bar-code B, and any one may be omitted. Further, the label showing the number N and the label showing the bar-code B may be pasted on the ink pack 12. A part to be pasted with the label is enough any range as far as not overlapping the adjacent ink pack 12 and visually recognizable from the outside.

In the above mentioned embodiment, in case the data read by the bar-code reader 126 is different from the predetermined arranging order, the controller sends the error output instruction so as to cause the display 130 to output the error indication. The error notification may be conducted by a warning lamp or a buzzer other than the display 130.

In the above mentioned embodiment, the numbers N shown on the respective labels 17 of the six ink packs 12 are natural numbers from "1" to "6", and may be numerals, letters, marks generally known concerning the orders such as alphabets of "A" to "F".

In the above mentioned embodiment, the order distinguishing indicator readable by the reading instrument is the bar-code B, and any other indications may be used. For example, letters readable by OCR (optical character recognition) may be employed.

In the above mentioned embodiment, the ink cartridge 11 is provided with the circuit board 123, and this may be omitted.

In the above mentioned embodiment, the arranging order of the ink packs 12 and the order of accommodating the ink packs 12 into the main body 21 are the same, and it is possible to add the indication showing the order of accommodating the ink packs 12 into the main body 21 to the arranging order (disposing order) showing the arranging direction. In short, there is a case that stacking and accommodating the ink packs 12 into the main body 21 from both of left and right sides of the main body 12 shown in FIG. 12 toward the center thereof will result in a more efficient accommodation of the ink packs 12 from the viewpoint of ink capacities or the like. In such a case, in addition to the arranging order from left to right of the drawing, indications showing the accommodating order of the ink packs 12 into the main body 21 may be added to provide an efficient manufacture of the ink cartridge.

MODIFIED EXAMPLES

Each of the above mentioned first, second, third and fourth embodiments may be modified as follows.

In the above mentioned embodiments, one ink cartridge 11 accommodates the six ink packs 12, but the number of the ink packs 12 to be accommodated may be other numbers. That is, in the above mentioned embodiments, the printer 40 uses the inks of the six colors, and the ink cartridge 11 and the printer 40 are structured for supplying the inks of the six colors, but the present invention can be employed for inks of two colors or more (two kinds or more) different from one another.

In the above mentioned embodiments, the six ink packs 12 accommodated in one ink cartridge 11 have all of the same shape, but dimension, shape or material quality may be different.

In the above mentioned embodiments, the ink pack 12 is of the pillow type formed by thermally welding the four sides of the two sheets of the film members 114, 115, but no limitation is made thereto. In short, the ink pack 12 may employ a bag shape formed by one sheet of the film member, or one formed by bonding the film members of three or more sheets, for example, so-called gazette type formed by welding four sheets of flexible films.

In the above mentioned embodiments, the ink supply ports 15*a* of the ink packs 12 accommodated in one ink cartridge 11 are arrayed in a row horizontally, but may be vertical other than horizontal.

In the above mentioned embodiments, the ink pack 12 is accommodated in the tilting posture, but may be other postures. For example, on the horizontally arranged ink packs 12, other ink packs 12 may be piled.

In the above mentioned embodiments, the ink packs 12 are arranged in a single row in the supporting case 13, but may be arranged in a plurality of rows.

In the above mentioned embodiments, the ribs 27 are integrally furnished in the case main body 21 as the posture keeping device for keeping the ink packs 12 in the tilting posture, but the ribs may be furnished separately.

In the above mentioned embodiments, as the liquid ejecting device, explanation has been made to the printer 40 ejecting the ink, but other liquid ejecting devices may be employed, for example, a printing device including a facsimile or copier, liquid ejecting devices ejecting liquid of electrode materials or color materials used to production of a liquid crystal display, EL display and a field emission display (FED), a liquid ejecting device ejecting biologically organic matters used for production of biochips, or sample ejecting devices as a precision pipette. Fluid (liquid) is not limited to the ink, and the present invention maybe applied to other fluid (liquid). In addition, the liquid container may be mounted on other devices than the liquid ejecting device. The liquid container may be used for mounting to other devices.

What is claimed is:

1. A liquid container comprising:

a liquid container case;

at least four liquid storing packs accommodated in the liquid container case so that adjacent ones of the liquid storing packs are arranged in partially-overlapping fashion in a first direction, wherein, amounts of liquid stored in the liquid storing packs have a plurality of levels;

the liquid storing pack storing the largest amount of liquid is not centered relative to the first direction; and an interval between center portions of adjacent ones of the liquid storing packs arranged in a position closer to an end of the liquid container case in the first direction is shorter than an interval between center portions of adjacent ones of the liquid storing packs arranged in a position closer to a center of the liquid container case in the first direction.

2. A liquid container according to claim 1, wherein the liquid storing pack storing the largest amount of liquid is arranged at an end of an arrangement of the liquid storing packs.

3. A liquid container according to claim 1, wherein the liquid storing pack storing the smallest amount of liquid is located between the other said liquid storing packs.

4. A liquid container according to claim 1, wherein the liquid storing packs are arranged from both ends toward the center in order from the liquid storing pack storing the largest amount of the liquid.

5. A liquid container according to claim 1, wherein the liquid storing packs are arranged from the center toward both ends in order from the liquid storing pack storing the least amount of liquid.

6. A liquid container according to claim 1, wherein each of the liquid storing packs comprises a bag body of flexible film and a liquid outlet member having a liquid outlet port for discharging the liquid from the interior of the bag body.

7. A liquid container according to claim 6, wherein each liquid storing pack is formed by welding four sides of two sheets of the flexible film.

8. A liquid container according to claim 6, further comprising:

a plurality of support portions provided in the liquid container case and supporting the liquid storing packs so that center axes of the liquid outlet ports lie in a same horizontal plane.

9. A liquid container according to claim 1, wherein the liquid storing packs are accommodated so that the liquid storing packs are tilted at a predetermined angle with respect to the liquid container case.

10. A liquid container according to claim 9, further comprising:

a posture keeping member provided in the liquid container case and keeping the liquid storing packs tilted at the predetermined angle.

11. A liquid container according to claim 1, wherein the liquid is an ink.

12. A liquid ejecting device comprising the liquid container according to claim 1.

13. A liquid container, comprising:

a plurality of liquid storing packs, each having an outlet part for discharging liquid to an exterior, and a liquid storing part communicating with the outlet part and containing the liquid therein;

a liquid container case accommodating therein the liquid storing packs arranged in a predetermined arranging order so that adjacent said liquid storing parts of the packs are arranged in partially-overlapping fashion; and a plurality of order distinguishing indicators respectively disposed on the liquid storing packs at regions not overlapped by adjacent said packs so that each said liquid storing pack has at least one associated said order distinguishing indicator, the order distinguishing indicators showing information concerning the predetermined arranging order of the liquid storing packs.

14. A liquid container according to claim 13, wherein each of the order distinguishing indicators has an indication readable by a checking device.

15. A liquid container according to claim 13, wherein each of the order distinguishing indicators is a bar-code.

16. A liquid container according to claim 13, wherein the order distinguishing indicators includes visually recognizable indications having at least one of shapes and sizes by which the arranging order can be distinguished visually, and the order distinguishing indicators are continuous correspondingly to the arranging order.

17. A liquid container, comprising:

a plurality of liquid storing packs, each having an outlet part for discharging liquid to an exterior, and a liquid storing part communicating with the outlet part and containing the liquid therein;

a liquid container case accommodating therein the liquid storing packs arranged in a predetermined arranging order so that adjacent said liquid storing parts of the packs are arranged in partially-overlapping fashion;

a plurality of first order distinguishing indicators respectively provided on the liquid storing packs, that indicate information about the arranging order of the packs, each said liquid storing pack having at least one associated said first order distinguishing indicator, and having at least one of shapes and sizes by which the arranging order can be distinguished visually, and that are continuous in accordance with the arranging order; and a plurality of second order distinguishing indicators respectively provided on the liquid storing packs, that indicate the information about the arranging order of the packs, each said liquid storing pack having at least one associated said second order distinguishing indicator, and that are readable by a checking device, wherein the first and second order distinguishing indicators are disposed on the ink storing packs at regions not overlapped by adjacent said packs.

18. A liquid ejecting device mounting the liquid container according to claim 13 or 17 thereon, comprising:

a liquid ejecting head having a plurality of nozzles configured to eject liquid therefrom, wherein each of the nozzles is communicated with an associated one of the liquid storing packs.

19. A method of checking an arrangement of a plurality of liquid storing packs, each having an outlet part for discharging liquid to an exterior and a liquid storing part communicating with the outlet part and containing the liquid therein, the method comprising the steps of:

disposing a plurality of order distinguishing indicators onto predetermined parts of the liquid storing packs, respectively, so that each said liquid storing pack has at least one associated said order distinguishing indicator, the indicators showing information concerning a predetermined arrangement order of the liquid storing packs;

arranging and accommodating the liquid storing packs in a liquid container case so that adjacent said liquid storing parts of the packs are arranged in partially-overlapping fashion; and checking whether the liquid storing packs are arranged in the predetermined arrangement order within the liquid container case based on the order distinguishing indicators after the liquid storing packs are arranged and accommodated in the liquid container case.

20. A liquid container comprising:

a first liquid storing pack and a second liquid storing pack, each including:

a flexible liquid storing part having an upper surface and a lower surface, a liquid outlet member attached to the liquid storing part and having a liquid outlet port in fluid communication with an interior of the liquid storing part, and a label attached to the upper surface and having an indication;

a liquid container case including:

a base defining a bottom surface, and a first side wall intersecting the base, and receiving the liquid outlet members of the first and second liquid storing packs, wherein:

the lower surface of the liquid storing part of the first liquid storing pack partly contacts the bottom surface;

the lower surface of the liquid storing part of the second liquid storing pack partly contacts the upper surface of the liquid storing part of the first liquid storing pack and the bottom surface;

the label of the first liquid storing pack is positioned on a part of the upper surface of the liquid storing part so that the indication of the label of the first liquid storing pack does not overlap the lower surface of the liquid storing part of the second liquid storing pack; and the indications of the labels of the first and second liquid storing packs cooperatively indicate visually that first and second liquid storing packs are disposed adjacent to each other within the liquid container case.

21. A liquid container comprising:

a liquid container case; and at least four liquid storing packs accommodated in the liquid container case so that adjacent ones of the liquid storing packs are arranged in partially overlapping fashion in a first direction, wherein an interval between center portions of adjacent ones of the liquid storing packs arranged in a position closer to an end of the liquid container case in the first direction is shorter than an interval between center portions of adjacent ones of the liquid storing packs arranged in a position closer to a center of the liquid container case in the first direction.

22. A liquid container according to claim 21, wherein amounts of liquid stored in the liquid storing packs have a plurality of levels, the liquid storing packs are arranged in the liquid container case in accordance with the amounts of liquid therein to reduce pressure differentials between the liquid storing packs to a minimum, and the liquid storing packs are arranged from the center toward both ends in order from the liquid storing pack storing the least amount of liquid.

23. A liquid container comprising:

a liquid container case;

at least four liquid storing packs accommodated in the liquid container case so that adjacent ones of the liquid storing packs are arranged in partially-overlapping fashion in a first direction, each of the liquid storing packs storing liquid therein and provided with a liquid outlet port configured to discharge the liquid therefrom, wherein:

amounts of liquid stored in the liquid storing packs have a plurality of levels: and the liquid storing pack storing the largest amount of liquid is not centered relative to the first direction: and an interval between the liquid outlet ports of adjacent ones of the liquid storing packs arranged in a position closer to an end of the liquid container case in the first direction is shorter than an interval between the liquid outlet ports of adjacent ones of the liquid storing packs arranged in a position closer to a center of the liquid container case in the first direction.

24. A liquid container comprising:

a liquid container case: and at least four liquid storing packs accommodated in the liquid container case so that adjacent ones of the liquid storing packs are arranged in partially-overlapping fashion in a first direction, each of the liquid storing packs storing liquid therein and provided with a liquid outlet port configured to discharge the liquid therefrom, wherein:

an interval between the liquid outlet ports of adjacent ones of the liquid storing packs arranged in a position closer to an end of the liquid container case in the first direction is shorter than an interval between the liquid outlet ports of adjacent ones of the liquid storing packs arranged in a position closer to a center of the liquid container case in the first direction.

* * * * *